US007866102B2

(12) United States Patent
Meahl

(10) Patent No.: US 7,866,102 B2
(45) Date of Patent: Jan. 11, 2011

(54) COVE BASE CORNER COVER

(76) Inventor: Gregory L. Meahl, 75 Esperanza, #E, Sierra Madre, CA (US) 91024

( * ) Notice: Subject to any disclaimer, the term of this patent is extended or adjusted under 35 U.S.C. 154(b) by 483 days.

(21) Appl. No.: 11/983,122

(22) Filed: Nov. 7, 2007

(65) Prior Publication Data

US 2009/0113840 A1 May 7, 2009

(51) Int. Cl.
*E04B 2/00* (2006.01)

(52) U.S. Cl. ..... 52/288.1; 52/287.1

(58) Field of Classification Search ..... 52/287.1, 52/288.1, 265, 631
See application file for complete search history.

(56) References Cited

U.S. PATENT DOCUMENTS

| | | | | | |
|---|---|---|---|---|---|
| 2,069,289 | A | | 2/1937 | Swendsen et al. | |
| 2,307,338 | A | | 1/1943 | Shiyter et al. | |
| 2,915,794 | A | | 12/1959 | Hillmann | |
| 3,707,061 | A | | 12/1972 | Collette | |
| 3,782,235 | A | | 1/1974 | Curcio | |
| 3,942,295 | A | * | 3/1976 | Schacht | 52/287.1 |
| 4,095,500 | A | | 6/1978 | Rouse | |
| 4,150,517 | A | | 4/1979 | Warner | |
| 4,161,853 | A | | 7/1979 | Weiss et al. | |
| 4,315,390 | A | * | 2/1982 | Schaafsma | 52/287.1 |
| 4,436,014 | A | | 3/1984 | O'Neill | |
| 4,852,318 | A | | 8/1989 | Anderson | |
| 5,010,703 | A | * | 4/1991 | Pearlman et al. | 52/287.1 |
| 5,179,811 | A | * | 1/1993 | Walker et al. | 52/288.1 |
| 5,199,237 | A | | 4/1993 | Juntunen | |
| 5,522,296 | A | | 6/1996 | Stroller | |
| 5,549,862 | A | | 8/1996 | Vail | |
| 5,756,933 | A | * | 5/1998 | Pitchford et al. | 174/481 |
| 5,802,790 | A | | 9/1998 | Lamont et al. | |
| 5,893,246 | A | * | 4/1999 | Smythe, Jr. | 52/287.1 |
| 5,904,017 | A | * | 5/1999 | Glatz et al. | 52/287.1 |
| 6,073,406 | A | * | 6/2000 | Kearney | 52/287.1 |
| 6,216,407 | B1 | * | 4/2001 | LeBlanc | 52/287.1 |
| 6,237,459 | B1 | | 5/2001 | Brown | |
| 6,419,207 | B1 | | 7/2002 | Barry et al. | |
| D486,920 | S | * | 2/2004 | Hein et al. | D25/102 |
| 6,969,055 | B1 | | 11/2005 | Schwind | |
| D549,844 | S | * | 8/2007 | Beard, Jr. | D25/102 |

(Continued)

*Primary Examiner*—Terrell Mckinnon
*Assistant Examiner*—Alp Akbasli
(74) *Attorney, Agent, or Firm*—George P. White

(57) ABSTRACT

Two integrally formed multipurpose devices with the resemblance of an aesthetic pillar hollowed out incorporating a cove element at the lower portion that is preformed to fit over and cover intersecting corners of previously installed cove base used in the flooring industry. The Cove base corner cover provides a unified junction between the two adjacent sides of a corner. This invention also provides an inexpensive, simplistic and productive procedure for installations of inside and outside corners. Precision cuts along with most all of the numerous steps currently being utilized to navigate into or from and around intersecting corners is eliminated. The problems such as, the cove element collapsing into itself as well as the popping of the upper edge associated with wrapping cove base around a corner, is also eliminated and for the most part, frustration and aggravation incurred while facilitating installations at the corners is significantly reduced. Repairs of damaged, cracked and split corners of already existing wall coverings are easily achieved with the use of the Cove base corner cover along with adapting the purpose as a corner protector while ultimately providing a final presentation of a well-designed and high-quality end result.

21 Claims, 2 Drawing Sheets

U.S. PATENT DOCUMENTS

D581,060 S * 11/2008 Beard, Jr. ..... D25/102
7,591,118 B2 * 9/2009 Shaw et al. ..... 52/718.04
2003/0014931 A1 * 1/2003 Hahn ..... 52/287.1

* cited by examiner

COVE BASE CORNER COVER

BACKGROUND OF INVENTION

1. Field of Invention

This invention relates to cove base, also referred to as wall base, rubber/vinyl base, vinyl mop base, and top set within the classification of wall coverings in the flooring industry. Specifically to the installation and repairs and of cove base at intersecting corners.

2. Prior Art

Installing cove base at intersecting corners can be very difficult and time-consuming. Even the professional can dread the procedure of installing cove base after installing the floor covering. In the flooring industry coving was introduced during the period when linoleum based flooring was being predominately used as a hard surface floor covering. Today the primary substitute is vinyl based resilient floor covering. The term coving is used to describe flooring extending from the floor at the edges and traversing up the wall in one continuous piece of material. At the apex where the floor and wall converge, the material is curved creating the cove. It is my understanding that coving was introduced to circumvent decomposition and dilapidations caused by excessive mopping. Coving is very difficult to install and requires a well-trained professional as well as being very expensive. Inside and outside corners are very difficult to implement. Outside corners especially, in that a piece of material has to be added on one side or the other where a void is left from the cut out created by the material extending up the opposite and separate side wall. Cove base was introduced later to provide a less expensive and more manageable process to achieve the transition from floor to wall while asserting the same functionality as coving. Nevertheless inside and outside corners can still be particularly troublesome and difficult to establish.

The most common and widely used method currently being utilized for installing cove base around outside corners is to wrap them. This process can be very frustrating and time-consuming taking many steps to accomplish the task. This most often results with an undesirable appearance, being that the bottom cove portion collapses into itself. If not, the pressure produced usually stresses the bottom contour to point of eventually splitting creating a gap in an open reverse V form. One of the steps in the procedure is reducing the material in the back, a must, at the bend so it will conform around the corner. This is done by gouging out the back side or by bending the material back side up and carving material out in order to create a groove. If to much material is taken out, a hole is created on the front side, so consequently you must start over with a new piece and quite possibly the piece you have damaged may have to be discarded. Reducing material from the back is imperative and invariably reduces the integrity at the corners vertex. Another particular disadvantage and frustrating aspect of wrapping, is the pressure that is created at the top portion of the base from the vertex and for the most part, it routinely pops away at the top edge from the wall on one side or the other, if not on both sides.

Inside corners are usually less troublesome. Nevertheless, they also have their quirks, such as a wall that is out of plumb and the choice is cutting to the corner rather than bending through it, the cut most likely will have to be done at an angle. Caulking is also generally used for filling in voids which create color match problems and eventually attracts dirt. Outside corners as well, share this anomaly. When bending through to accomplish installation at an inside corner, generally a slight slice is made on the back side and the bottom cove is cut out at about a 45 degree angle creating a reverse V notch. Unless starting a run of base is at the inside corner, precise measurement is imperative.

Between the extra labor incurred and possible other complications associated with facilitating installations at intersecting corners, a better method has been sought. Several types of inventions have been created to address some of these problems. For example U.S. Pat. No. 5,522,296 (1994) to Stroller, Cove base cutter guide and U.S. Pat. No. 6,237,459 to Brown, Corner making tool. These tools address the collapsing of the cove portion as well as the popping out at the top edge. These are still time-consuming and the installer must be very precise. Adjoining the mitered edges to align perfectly together is another problem in and of itself. The joint edge of the miter, being of two separate pieces, does not have the same structural integrity that my invention provides. Also my invention can easily repair a damaged corner installed using this In accordance with the present invention, each of the Cove base corner covers comprises an integrally formed cover for an external corner of Cove base with an elongated midsection defining a pair of generally flat perpendicular faces intersecting to thereby form an external vertex and a hollow interior that may be placed over an intermediate portion of cove base at internal and external corners. The corners also having a respective concave face extending downwardly and forwardly from each miter method. Another type of invention that has been created to address one of these problems is U.S. Pat. No. 6,419,207 (2002) for Barry & Morrison, Vinyl base wall clamp. This apparatus is used for applying pressure at the side of the vertex until the adhesive has set precluding the corner edges from popping away from the wall. Again this is not only time-consuming, it does not address the problem of the lower portion cove collapsing into itself. In actuality, the most common method adapted is to used a brad nail to hold the material in place, yet using this method usually leaves an indentation or even a hole. For the most part, only the professional floor installer would have one of these cove base tools if in fact they were even aware of their existence, let alone know where to acquire them. My invention addresses these situations with a more simplistic productive procedure and resolve.

For many commercial applications 6" cove base is often used and is very often mandated especially for use in restaurants, medical buildings and numerous other businesses which are overseen by the health department. 6" cove base is extremely difficult to wrap or miter. Inconsistencies and variations of the walls increase with the height and take a great deal more effort as well as time to accomplish navigating around, into or from intersecting corners. The attributes of my invention become even more evident in these such situations. Cracked corners and splits creating a void at the bottom seem to be more apparent with cove base having higher stature than those of their shorter counterparts.

Other prior art of possible relevance is U.S. Pat. No. 2,307,338 to Shiyter et al. (1943) Base fitting for interior walls. This invention, though it is similar in appearance and share some of the objectives, such as the collapsing of the cove element and popping from the vertex edge, is still inferior to my invention for numerous reasons. This invention requires that it be placed directly on the wall and attached with tabs extending from it, with holes for fastening at the lower portion, along with recessed lugs installed prior to the fitting in order to snap fitting permanently in place. This requires time and effort especially if the wall itself requires preparation for fastening along with the installation of the fastening system. The cove base requires precise fitting in order to be adjoined to the base fitting. With the Cove base corner cover precise cuts are not required, extensive preparatory work for fastening also is not required nor does it have the additional use to perform repairs of cracked and damaged corners. My invention is simply placed over the cove base and not directly on the wall without any special consideration.

Another prior art of possible relevance is U.S. Pat. No. 5,199,237 to Juntunen (1991) Miterless molding system. This invention is similar to my invention in that it is a decorative receptacle covering intersections providing the appearance of a finished joint between the adjacent rough cut ends. Aside from its completely different appearance, its use is for carpentry related molding such as crown, chair and base molding, not that of cove base wall coverings.

Other prior art of a pre-molded outside corner is manufactured by a manufacturer of cove base. The design is different in that the bottom portion cove is completely round at the bottom and the face extends a few inches away from the vertex. The product attaches to the wall as well as the form of the back side precludes it from being placed over the cove base itself. Once again precision is needed to adjoin the cove base it is being installed along with as well as requiring a perfect color match. These are very expensive and are not as simple in their use.

SUMMARY in accordance with the present invention, both of the Cove base corner covers comprises an integrally formed cover for an external corner of cove base within an elongated midsection defining a pair of generally flat intersecting to thereby form an external vertex and a hollow interior that may be placed over an intermediate portion of cove base at internal and external corners. The corners also have a respective concave face extending downwardly and forwardly from each perpendicular face with the two concave faces intersecting to form a foreword projecting lower extension of the external vertex creating the cove elements having at least a portion of the interior base portion being hollow whereby the base portion may be placed over to adjoining cove portions of cove base at intersecting corners. The corner covers are athletically designed with an overall appearance resembling that of a pillar. It provides an improved method for use with installations of pre-manufactured base at intersecting corners. It extends slightly beyond the cove base it is attached over yet it structure depicts unity with its face extending a minimal distance beyond the corner so as not to appear obtrusive with the edges being tapered allowing it to blend in more readily. This allows for the overall appearance to exhibit completeness.

DRAWINGS

DETAILED DESCRIPTION

A preferred embodiment of the corner cover of the present invention is illustrated in FIGS. 1,2,3 and 4, outside corner cover, and 5&6, inside corner cover. The cover has an integrally formed elongated body comprised of thin walls. I prefer the thickness of these walls to be between 0.10 and 0.125 of an inch along with being tapered round to the edges. However the thickness can be varied as thin as a piece of tin or sheet metal or as thick up to ½ of an inch, depending on what is called for. An example would be for use as a very durable corner protector. Each side should be of sufficient horizontal width to overlap and cover cuts made without exact precision.

There is no one preferred color for the Cove base corner cover. The actual preferred color would be that of the cove base it is being placed over. Matching the color would be ideal, however a color of similar resemblance would suffice quite well. Depending on the shading of light, a perfect match often appears to have different shade of color. Clear corner covers absorb and reflect the color of the base installed beneath them and therefore they are best suited to be used universally. Wood and metals may also be used universally, although these are more limited in there scope.

Figure 1:
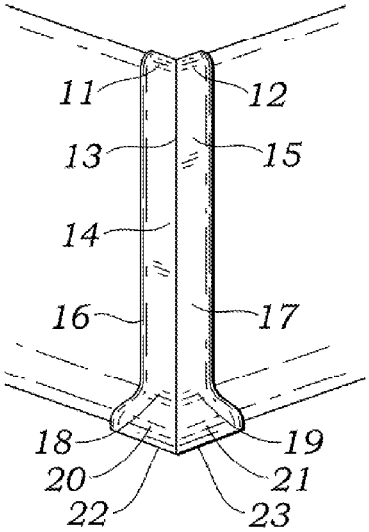
FIG. 1 shows a first embodiment of a outside Cove base corner cover from a front view as having an elongated body with a rounded top extending away, a flat face tapered round to the edges and a cove element rounding to the bottom extending forward.

The preferred embodiment as shown in FIG. 1 is a front prospective view of the outside (external) Cove base corner cover. The two front sides are perpendicular and identical to each other having a predetermined contoured shape with the lower portion consistent with that of cove elements of already existing rubber/vinyl wall coverings. The upper portion of the invention 11& 12 and shown rounded and tapered conforming to the cover base beneath it. Front vertical corner, the vertex, 13 may be rounded or squared. The left side 14 and the right side 15 is the midsection face that is flat and tapered off round to the edges 16& 17 and lower portion of the invention 18& 19 extending outwards and forwardly down in a contoured predetermined curved cove shape, the cove element, finishing off 20 & 21 with a curve downwards to the bottom 22 &23.

Figure 2:
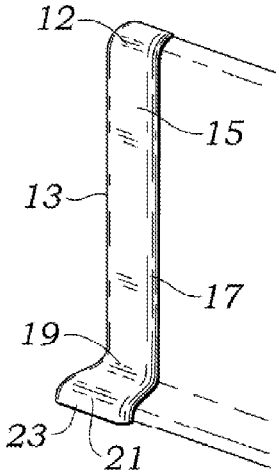
FIG. 2 shows the right side of the FIG. 1 embodiment with a rounded top extending outwards to the right and the edges tapered round with the cove element rounding to the bottom extending outwards to the left.
Figure 3:
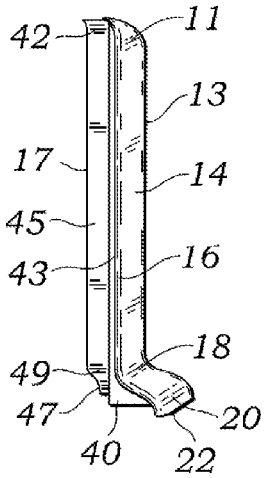
FIG. 3 shows the corner cover left side with the top, the vertical edge and cove element edge and bottom rounded and tapered extending to the right. It also shows the backside of the right front face along with remaining support material at the vertical vertex as well as underneath the cove element crest.

FIG. 2 is the right side first embodiment perspective view of the outside cove base corner cover where in the upper portion of the invention, the top 12 extends away to the right, in order to conform to the top of the side of cove base previously installed with the end being tapered to the underneath side. The vertex 13 can be squared or rounded. The right side face 15 is flat and tapered round to the edges in order to conform and blend in aesthetically as it engages with the cove base it overlaps. The lower portion 19 extending outwardly to the left and down in a contoured curved cove shape finishing off downwards being curved through to the bottom. FIG. 3 is the left perspective view of the outside Cove base corner cover that is a semblance image of the right side FIG. 2 with a glimpse of both the vertical 43 and underside cove element support material 40 showing and 45 a backside glimpse of the right side FIG. 1 16.

Figure 4:
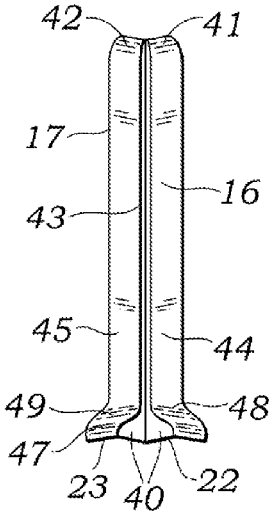
FIG. 4 shows the backside of the corner cover with the underside top rounded extending towards viewer along with both right and left backside face and the backside of the vertical vertex with support material remaining as well as on the underside of cove element. The cove element underside is shown and extending away.

FIG. 4 is a backside view of the invention wherein the backside of the front vertical vertex 13 is shown with material remaining 43 providing even greater satiability while 40 represents the material remaining on the underside of the cove element crest. The backside, a however must remain flat and conform with the wall coverings it is being in the attached over where adhesive may be applied or as I prefer, the peel and system of adhesion.

Figure 5:
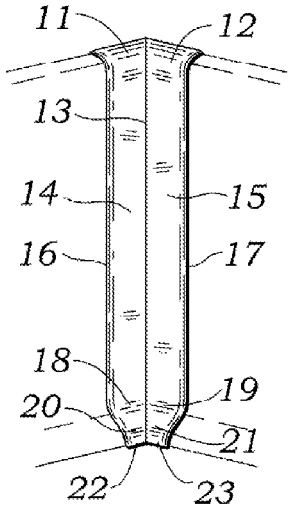
FIG. 5 shows a first embodiment of the inside Cove base corner cover from a front view with both sides extending forwardly at about a 90 degree angle from each other with the top portion being rounded and tapered extending outwardly with a flat face tapering off round to the edge and the lower portion cove element rounded to the bottom extending forward.
Figure 6:
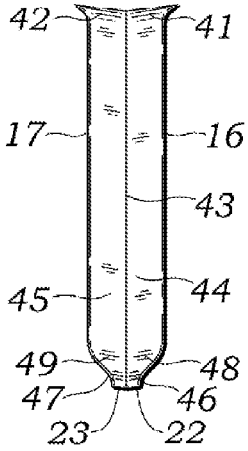
FIG. 6 shows the backside of the inside corner cover which is virtually the same formation as a front side consistent with the face of the manufactured cove base it is to be attached over.

The inside (internal) Cove base corner cover FIG. 5 is for the, most part, an inverted outside corner cover with the exception that the upper portion 11& 12 remaining the same as the outside corner cover extending away from in order to conform to and cover the base underneath it. The lower portion 18 &19 also remains the same extending outwards and forward to conform to and cover the cove element. The preferred embodiment, as it also is with the outside corner cover, is shown with all the edges tapered round 16& 17 and 20& 21. The backside FIG. 6 of the inside corner cover shown being very much the same as FIG. 5 except facing away without support material.

Figure 1A:
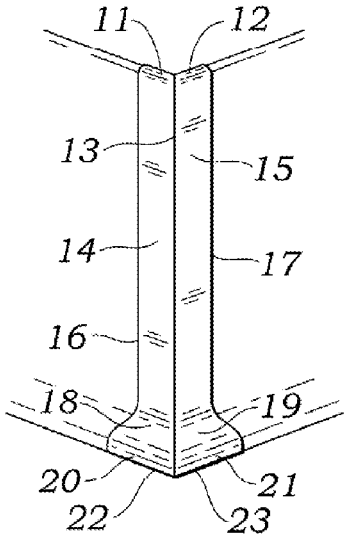
FIG. 1A shows an alternative embodiment with the top squared flush as well as the sides and lower portion of cove element at the bottom.

Alternative embodiments as shown in FIGS. 1A, 2A, 3A and 5A; where in each case the edges are shown as being squared and cut flush. In FIG. 1A, a front prospective view, the top portion 11& 12 is not rounded over and extending outwards and away, instead it is cut flush where in the top edge may be squared flat or as I prefer, it is tapered round the backside. The bottom 20& 21 is shown as also being squared and flush.

Figure 2A:
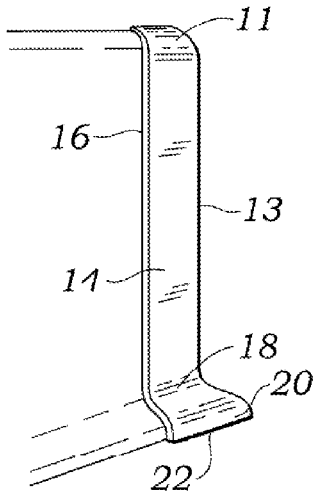
FIG. 2A shows the corner cover left side with the top portion rounded and tapered extending outwards to the left with the edges and bottom squared flush and the cove element extending to the right.
Figure 3A:
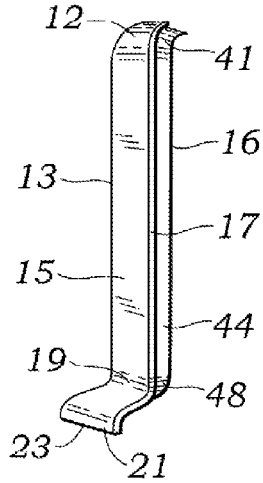
FIG. 3A shows the right side with a rounded and tapered top extending outwards to the right with the entire edge squared flush and cove element extending to the left. It also shows a portion of the backside of the left front face.
Figure 5A:
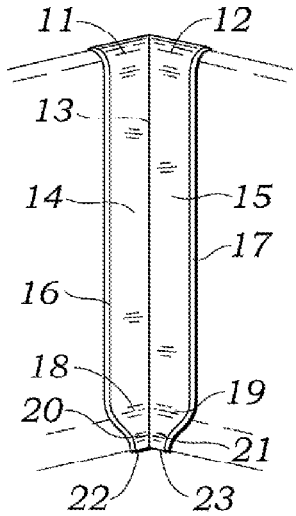
FIG. 5A shows an alternative embodiment front view of the inside corner cover with the edges and bottom squared flush. The inside corner cover is for the most part, an inverted outside corner.

In FIG. 2A, the alternative embodiment perspective view of the left side, is with the edge 17 and lower portion 21 squared flush. In FIG. 3A the right perspective view, a glimpse of the backside 45 of the right side 15 is showing. The top portion 12 and backside top portion 41 is shown being rounded and tapered to the end with the edges 17 and lower portion 21 as being squared flush. The inside corner cover as illustrated in FIG. 5A is a semblance image of that rendered in FIG. 5 with the exception of the edges all being squared flush.

Figure 4A:
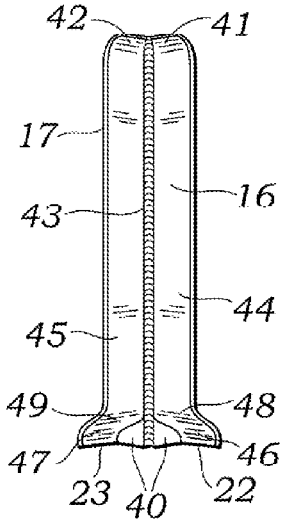
FIG. 4A shows a similar backside Cove base corner cover with the vertical vertex having material rounded out and material remaining at the underside of the cove element.

The backside of the outside corner cover FIG. 4A is the same as the rendition in FIG. 4 except depicted with material removed and rounded out 43 on the backside of vertical vertex 13 providing more stability rather than being cut to a 90 degree angle, which can also be done, as well as material remaining 40 underneath the cove element crest. It also illustrates the upper portion 41&42 being rounded and tapered to the end.

There are various possibilities with regard to the relative disposition of the edges wherein for all practical purposes, any edge can be interchanged from one configuration to the other although the backside must remain flat and conform with the wall coverings of the cove base it is being attached over.

The manufacturing of this invention can be accomplished in a variety of ways depending upon its composition. I prefer the composition of material to be used in the manufacturing of this invention to be rubber/vinyl the same as with pre-existing manufactured cove base used in the flooring industry. This material is flexible and therefore is able to adapt more readily to the irregular walls and corners. The process used to manufacture this device I also prefer to be molding injection. This invention can also be produced and manufactured with other materials such as wood, metals and most forms of plastic, but not limited to any material or process of manufacture. With the above-mentioned composition in most cases can be produced, but not limited to, Mill 3-Axis. Materials that are rigid, generally will be produced for economical reasons. Eventually the market, especially, and manufacturing cost will determine the best mode of production.

Installation and Use:

Installations of cove base with the Cove base corner cover become very simple, efficient, quick and easy to accomplish. The manner in which one installs the most economical version of the corner cover merely consists of applying adhesive such as contact cement or other compatible adhesive, to the backside FIG. 4 44-49 and placing it directly over the rough end cuts of the previously installed cove base at the intersecting corner. The method I prefer however, especially if time is money, the Cove base corner cover that has been manufactured with the peel and stick system of adhesion making the process even more simplistic. Just peel the tab from the backsides 44-49 and place into position. Certainly for all practical purposes, situations do arise that require some modifications for placement.

The outside Cove base corner cover, FIGS. 1 thru 4, provides a means to simplify as well as significantly reduce the time spent accomplishing installation of an outside corner. The most common method currently being utilized for installation of cove base around an outside corner can be very difficult and troublesome. The process begins by positioning the cove base in place without adhesive and marking the back from the edge of the corner to be navigated around. This can prove to be very difficult in a confined space or with an irregular wall. Material must be removed from the backside creating a groove along the mark without cutting through the material and of course, if too much is removed creating a hole, the process must start over and the piece that has been damaged may very possibly have to be discarded. Most common method of accomplishing this is by bending the backside up and using a utility knife to remove the material along the mark. Next after applying adhesive it must be wrapped around the corner and in most cases there is not enough downward pressure causing the cove portion 18&19 to collapse inwards losing its definition When there is enough downward pressure to keep the cove definition, eventually in time, the bottom usually splits creating an open Λ gap at the bottom 20&21 to where the cove element once was 18&19.

Another common and frustrating element of wrapping base around corners is that the top portion tends to pop out at the top edge from the vertex away from the wall on one side or the other, if not both sides, from pressure instead of securing properly to the wall. Inferior remedies include a miter, which can be very difficult because of flexibility of the cove base if not in possession of a cove base cutter guide, which has also been invented for a resolution of some of these idiosyncrasies including the cove portion collapsing into itself. In reference to popping at the top edge created by pressure from the vertex, use of a wall base clamp, invented also as another remedy, can be used yet it also is time-consuming. The most common and widely used approach is the use of a brad nail which usually creates an indentation if not a hole. Filling in the indentation or hole is particularly difficult expressly pertaining to the different colors of cove base. The inventions as previously mentioned do have their merits, provided you know of their existence and as well as where to acquire them and accordingly they still fall short compared to the advantages of the Cove base corner cover.

To install an outside Cove base corner cover the manufactured cove base is installed in the usual manner with the exception that each separate length is rough cut somewhat flush at the corner. The cuts will be covered therefore there is no need for precision. After installing the cove base on each side, pull the tab off the backsides 41-49 exposing the adhesive, align in place over both adjacent cuts and press to form a bond. This creates a unified junction between both adjacent sides of the corner having the decorative appearance of an aesthetically designed pillar FIG. 1. Because the corner cover extends slightly beyond the base, though not enough to be obtrude, my preference is to have the edges 16&17 tapered round allowing for it to blend in more readily.

Inside corners can also prove to be troublesome, although not nearly as much. An example of this is an irregular and/or out of plumb wall. In these cases cutting to or from the corner, instead of bending through it, generally the cut must be made at an angle in order to conform to the plumb of the wall. Inside corners require the cove portion of cove base being installed to be cut out at about a 45 degree angle to the bottom. Precision is required whether or not cutting to or from or bending through, in order that both adjacent sides adjoin each other properly. Outside corners as well, tend to be hampered by the irregularity and variations of the wall. Coping is another method used if the wall is not to far out of plumb although one side still needs to be cut with precision. Sometimes caulking is used in order to fill in the gap which is very difficult in relation to the color of cove base the used.

When using the inside corner cover FIGS. 5&5A with the installation of cove base, the 45 degree cutout of the cove should be made in order to provide sufficient horizontal width 14&15 to overlap and cover the cuts. There is no need for exact precision for neither the axis cut nor the cove cutout. The same application is used to install the inside corner cover as the outside corner cover with the exception of the 45 degree cut out of the cove. For some commercial applications 6" cove base is often required. Navigating around or to intersecting corners can be very cumbersome and frustrating. In such cases the Cove base corner covers are especially useful and accommodating in retrospect to the plumb and irregularities of the wall. The higher the base, the more adversity that is involved with finishing corners.

Another attribute to this invention is the ease of installation around and under a cabinet with a toe-kick or some other obstruction. To accomplish this and individual length of base can be trimmed to one size and cut off flush at the corner while the adjacent side, being of a different height, is individually placed. This eliminates trimming an entire length of base at two different heights and then wrapping it, instead the cove base cover itself can easily be trimmed on its face 14 or 15 to fit underneath the cabinet and if the adjacent side is full size, a finished curved end at the top portion 11 or 12 is produced.

This invention is also very useful for providing a method to perform repairs to cracked and damaged corners of already existing wall coverings. This can be accomplished by removing excess material at the vertex of the corner and cleaning off dirt and grime where the corner cover will be attached. After applying adhesive, with the economical version, or pulling off the tab with the peel and stick system, simply align and place it directly over the cove base being repaired covering the void. Taking off the cove base and replacing it is no longer required as well as replacement with a perfect color match. Not only is the corner cover a device providing a method to perform repairs, it is also is a device having substantially more density as well as durability, providing a means for protecting corners.

Advantages:

From the description above a number of advantages of the cove base corner cover become evident. Accordingly, the objects and advantages of the corner cover described in my above patent, several objects and advantages of the present invention are;

(a) Provides for more simplistic, productive procedure for installing cove base around, into and from corners, saving time by significantly reducing the numerous steps involved as well as effort.

(b) Rough cuts at the intersection when installing cove base can be made without the requirement of the exact precision and with minimal consideration to the variations and/or plumb of the wall providing even the novice with the ability to achieve a superior and result.

(c) Eliminates the cove portion from collapsing into its self leaving an undesirable appearance or splitting at the cove portion leaving an open gap if there is enough downward pressure to keep the cove definition around the corner.

(d) Eliminating the popping at the top edge of the cove base from the vertex which is created by pressure from being wrapped around the corner. Because the cove base is cut flush at its end, pressure is nonexistent and therefore of no consequence.

(e) Providing the point at the vertex with the substantially more density and durability. The Cove base corner cover is preformed to extend around both sides of the corner without any reduction of material at the vertex and in fact, can be produced with extra added material allowing for even greater stability and durability establishing it as a corner protector also.

(f) Eliminating the process of wrapping, mitering any use of cove base clamp for accomplishing and finishing installations of outside corners.

(g) Eliminating the process of cutting to or from, coping or bending through to accomplish a finished inside corner.

(h) Provides a quick and easy procedure to repair damaged, split and/or cracked corners without having to remove and replace the entire section of cove base.

(i) Requires no extensive preparation for attachment.

(k) Installations under an around cabinets or other obstruction requiring modification is simplified and can be obtained with little difficulty.

(l) Frustration and aggravation associated with the installation at intersecting corners is significantly reduced if not completely eliminated.

(m) With the peel and stick system of adhesion applying adhesive is eliminated.

(n) Provides a unified junction between the two adjacent sides at intersecting corners of previously installed cove base comprising an aesthetic design with the resemblance of a decorative filler improving the appearance of Finnish corners.

Further objects and advantages are to provide a superior defined and result and overall aesthetic appearance that is simple to use and inexpensive to manufacture. The structure of each corner is unitary and continuity having a multitude of essential uses.

CONCLUSION

Accordingly the reader will see that this invention simplifies and very significantly reduces the complications associated with the installation of existing manufactured cove base as well as the time spent and effort involved in achieving a desired end result. Not only does this invention resolve many distinctive problems, it also completely eliminates numerous others. It is a multifunction device not only for installing cove base efficiently, it provides a means for repairing damaged and cracked corners along with its adaptation as a corner protector.

The professional as well as the novice will find that the inception of this device can be invaluable, not only does it serve as a decorative component with its aesthetic design, it improves the overall appearance especially that of the outside corner with the resemblance of a pillar. Its ease in application provides a means to reduce frustration, as well as aggravation, associated with installation of cove base in regard to navigating around and into intersecting corners. Skill and precision is so minimal anyone can acquire a professional outcome with little effort. Directions for use, because it is so simple to use, require only a few sentences that just about anyone can understand and follow. It is a very inexpensive as well as a practical and efficient method of completing a superior installation.

Although the description above contains many specificities, this should not be construed as limiting the scope of the invention but as merely providing illustrations of some of the presently preferred embodiments of this invention. For example the corner cover can have other shapes especially the edges which can be tapered round, rounded, beveled, squared flush and/or flat ect. The backside however must be consistent with the face of existing manufactured cove base.

Thus the scope of the invention should be determined by the appended claims and their legal equivalents, rather then by the examples that are given.

The invention claimed is:

1. An integrally formed cover for an external corner of cove base, comprising:

an elongated midsection defining a pair of generally flat perpendicular faces intersecting to thereby form an external vertex and a hollow interior, whereby the elongated midsection may be placed over an intermediate portion of said cove base at said external corner, and a base portion integrally formed with said elongated body and having a respective concave face extending downwardly and forwardly from each said perpendicular face, the two concave faces intersecting to form a forwardly projecting lower extension of said external vertex, at least a portion of the interior of said base portion being hollow whereby the base portion may be placed over two adjoining cove portions of said cove base at said external corner wherein said external corner is formed from two spaced part sections of said cove base, said cover further comprising an internal support extending from said vertex into said hollow interior and adapted to fit within the space between said two sections.

2. A corner cover for hiding the corner joint of two walls proximate to a floor, the cover generally elongated and generally symmetrically formed by two planar panels mutually connected at right angles; further said cover having a foot with a downward lip terminating in a bottom region that defines a lower plane; the upper extremity of the cover so shaped and configured such that when the lower plane of the foot is parallel to the floor and the upper extremity of said cover is in contact with the corner of the wall, the planar panel's surfaces parallel to and proximate to the walls are effectively spaced from the walls an effective amount of space between it and the walls' corner to which it is parallel to and immediately adjacent to in order to accommodate the thickness and shape of cove base and thereby to be able to hide a termination of the cove base behind said cover.

3. The corner cover of claim 2 wherein the orientation of the right angle connection is such as to provide for effective covering of an external corner.

4. The corner cover of claim 2 integrally formed.

5. The corner cover of claim 2 further comprising adhesive.

6. The corner cover of claim 3 wherein the edges of the planar panels opposed to the edge of mutual connection have a shape selected from the group of: tapered, beveled and rounded.

7. The corner cover of claim 2 wherein the orientation of the right angle connection is such as to provide for effective covering of an internal corner.

8. The corner cover of claim 4 substantially comprised of a flexible material.

9. A cover for a corner formed by the intersection of two walls comprising:

a) an upright member comprising two symmetrically disposed panels each of a substantially planar, elongated, thin, rectangular-solid shape and with substantially the same lengths; the panels mutually adjoined along respective first long edges to form a substantially 90-degree corner, whereby said upright member defines two sides, a generally convex side and an opposing generally concave side; further said upright member having an upper portion and a lower portion;

b) a foot depending from the lower portion of said upright member having a shape comprising two symmetric, generally planner regions each extending at an obtuse angle from one of the respective panels, the extending being in the direction of a first side of the two sides defined by said upright member; further said foot's lower region comprising a downward lip having a terminus that substantially defines a plane perpendicular to both of the of the panels' major planes;

c) a top extending from the upper portion of said upright member having a shape comprising two symmetric regions each extending at an obtuse angle from one of the respective panels, the obtuse angle being in the direction opposed to the direction of that of the foot; the extent of said top of a length whereby a corner cover held parallel to the intersection of the walls with its top abutted to the walls' corner defines an effective gap between the walls' respective surfaces and the corresponding parallel surfaces of the corner cover; and further, whereby in that orientation said top substantially hides an effective region behind the corner cover from view.

10. The cover of claim 9 wherein the foot, upright, and top are substantially integrally formed.

11. The cover of claim 10 wherein the defined gap is continuous with an upper aspect that is substantially linear leading to a generally arcuate lower aspect, whereby the shape of cove base is accommodated and further wherein the first side of the corner cover is its generally concave side and wherein the cover is substantially comprised of a flexible material.

12. The cover of claim 10 wherein the first side of the corner cover, is its generally concave side and said foot further comprises an exterior corner base.

13. The cover of claim 9 wherein the gap would be about one eighth of an inch.

14. The cover of claim 9 in which the thickness of the thin panels is between about 0.002 and 0.13 inches.

15. The cover of claim 10 wherein at least one panel surface has a peel off adhesive for securing the corner cover.

16. The cover of claim 11 further comprising an elongated lateral rib within the concave side.

17. The cover of claim 10 wherein the first side of the corner cover is its generally convex side thereby being effective for covering an interior corner.

18. The cover of claim 12 wherein said base has a horizontally radiused aspect.

19. A method of forming a uniform corner at two intersecting walls with cove base along the interface between the walls and a floor comprising, in any operative order:

a) cutting the cove base to an effective length to have a terminus that approaches the walls' intersection line within an effective distance;

b) covering the corner with an elongated, symmetrically shaped cover so shaped that with its foot's lip's extremity parallel to and adjacent to the floor and with an upper portion adjacent to the wall, the cover's two, right-angle upright planar surfaces are each parallel to the respective walls and the planar surface proximate to the walls have a gap between those portions and the walls' surfaces, the gap of an effective distance and shape to accommodate the thickness and shape of the cove base while hiding the cut terminus of the cove base.

20. The method of claim 19 further comprising: (i) adhering the cove base to at least one wall and (ii) adhering the corner cover to the cove base.

21. The method of claim 19 wherein the wall corner and the corner cover apparatus are of the shape of exterior corners.

* * * * *